United States Patent [19]

Ohnmacht

[11] Patent Number: 4,845,345

[45] Date of Patent: Jul. 4, 1989

[54] ELECTRICAL HEATING ELEMENT WITH MEANDER-SHAPED WINDINGS

[75] Inventor: Helmut Ohnmacht, Kandel, Fed. Rep. of Germany

[73] Assignee: Fritz Eichenauer GmbH & Co. KG, Kandel, Fed. Rep. of Germany

[21] Appl. No.: 70,238

[22] Filed: Jul. 6, 1987

[30] Foreign Application Priority Data

Jul. 4, 1986 [DE] Fed. Rep. of Germany ..... 3622478
Jan. 21, 1987 [EP] European Pat. Off. ..... 87100773.8

[51] Int. Cl.[4] ..... H05B 3/02

[52] U.S. Cl. ..... 219/546; 338/279; 338/280

[58] Field of Search ..... 219/546, 375, 376, 553; 338/293, 280, 279

[56] References Cited

U.S. PATENT DOCUMENTS 3,069,522 12/1962 Jamison ..... 219/546 X
3,237,142 2/1966 Nuss ..... 338/280
4,370,548 1/1983 Nagasawa et al. ..... 338/293

FOREIGN PATENT DOCUMENTS 1258523 7/1968 Fed. Rep. of Germany .
1274760 8/1968 Fed. Rep. of Germany .
1440404 6/1970 Fed. Rep. of Germany .
1615253 2/1973 Fed. Rep. of Germany .
3141828 10/1981 Fed. Rep. of Germany .

*Primary Examiner*—E. A. Goldberg
*Assistant Examiner*—M. M. Lateef
*Attorney, Agent, or Firm*—Antonelli, Terry & Wands

[57] ABSTRACT

An electrical heating element with a heat conductor in the form of meander-shaped windings, in which the individual windings are held in openings separated by solid parts in at least one insulating plate. For stabilization, especially with long, narrow designs of such a heating element, a retaining rail is provided, which extends over the entire width of insulaitng plates and essentially over their length and has tabs bent over along the side edges of insulating plates to grip the plates on both sides.

13 Claims, 3 Drawing Sheets

ELECTRICAL HEATING ELEMENT WITH MEANDER-SHAPED WINDINGS

BACKGROUND OF THE INVENTION

The invention relates to an electrical heating element with a heat conductor in the form of meander-shaped windings, with the individual windings being mounted in openings in at least one insulating plate divided by solid parts.

Eleectrical heating elements of this kind have been proposed in, for example, German Patent No. 11 85 743, German Patent No. 14 40 381, German Patent No. 14 40 404, and German Patent No. 12 74 760. Moreover, U-shaped, bent, sheet metal strips used as reinforcing rails have been proposed in, for example, German Patent No. 12 58 523 and German No. OS 31 41 828; however, at best, the strips described in those patents provide a reinforcement in one direction and cannot simply be used as return conductors. The use of a sheet metal strip as a return conductor in order to mount both terminals of a heating element for bread toasters on one side is proposed in German Patent No. 16 15 253.

The goal of the invention is to provide a heating element of the aforementioned, especially one with considerable length and limited width, with increased stability, in a manner which is simpler and more advantageous from the manufacturing standpoint.

According to the invention, this goal is achieved in an electrical heating element with a heat conductor in the form of meander-shaped windings, with the individual windings being mounted in openings in at least one insulating plate separated by solid parts. By virtue of the fact that a one-piece retaining rail is provided and extends over the entire width of the insulating plates and essentially over their entire length, and has tabs on the side edges of the insulating plates, which are bent over on both sides of the plates and grip them, it is possible to realize a stiffening of the support in two directions.

In accordance with one embodiment, provision is made for terminals for connecting electrical connectors at one end, and the heat conductors are electrically connected at the other end with the rail. Another embodiment provides for the rail to have openings and solid parts on the side facing away from the tabs. By virtue of this construction, in particular the different thermal expansion behavior of the insulating plates and the retaining rails is compensated for in a simple and optimal fashion so that no bending of the heating element, especially of the winding supports, occurs which could cause the ends of the windings to touch one another, producing a short circuit and hence a decrease in the resistance of the entire heat conductor and consequently damage to the latter. This is reliably prevented by the construction outlined above.

By virtue of the invention, a narrow, elongated, highly stable heating element is provided which is simple to manufacture. If the retaining rail is made of metallic material and is used as a return conductor, its terminal can be fastened firmly to it by eyelets or, in an extremely preferred embodiment, can be made integral with the retaining rail. The electrical connection between the heat conductor at the end which is opposite the terminal end is preferably accomplished by an eye, thus producing a reliable mechanical and electrical contact at this point.

While temperature switches (regulators and monitors) were formerly provided in heating elements of the aforementioned type, they had to be mounted in advance at a specified location. This specified location could not take into account the different installation conditions and hence different temperature conditions prevailing in different units, so that separate heating elements sometimes had to be provided for different units and had to be inventoried, or problems could arise, depending on the unit, such that the temperature switch would not respond under the desired temperature conditions.

Therefore, according to the invention, a temperature switch is displaceably mounted on the retaining rail, and, in particular, the retaining rail is gripped by the tabs of a retainer for a temperature switch. The use of continuous retaining rails makes it possible for the temperature switch to be secured to them to prevent its falling off or being removed, but permits it to be displaceably mounted tomove along the rail or rails. As a result, the complete heating element can be manufactured with the appropriate temperature switch and can be stored with a finisher who then, depending on the installation conditions, can slide the temperature switch along the rail to a desired location where it is either held positively or can be additionally mounted in such a way that it will not come loose, for example, by riveting or welding it to the rail. If the rail is made of side tabs connected by solid parts, an additional design provides for the temperature switch to be held in place on the retaining rail by the solid parts on the latter. The rail can also be used as a conductor for the current supplied through the temperature switch, so that the rail, by virtue of the holder for the temperature switch, provides a contact between the switch and an electrical connection. The other contact of the switch must be insulated from the switch mount and provided with a separate connecting element for connection of a cable.

Further advantages and features of the invention will be apparent from the claims and from the following description, in which one embodiment of the heating element according to the invention is described in detail with reference to the accompanying drawing.

DETAILED DESCRIPTION

Figure 1:
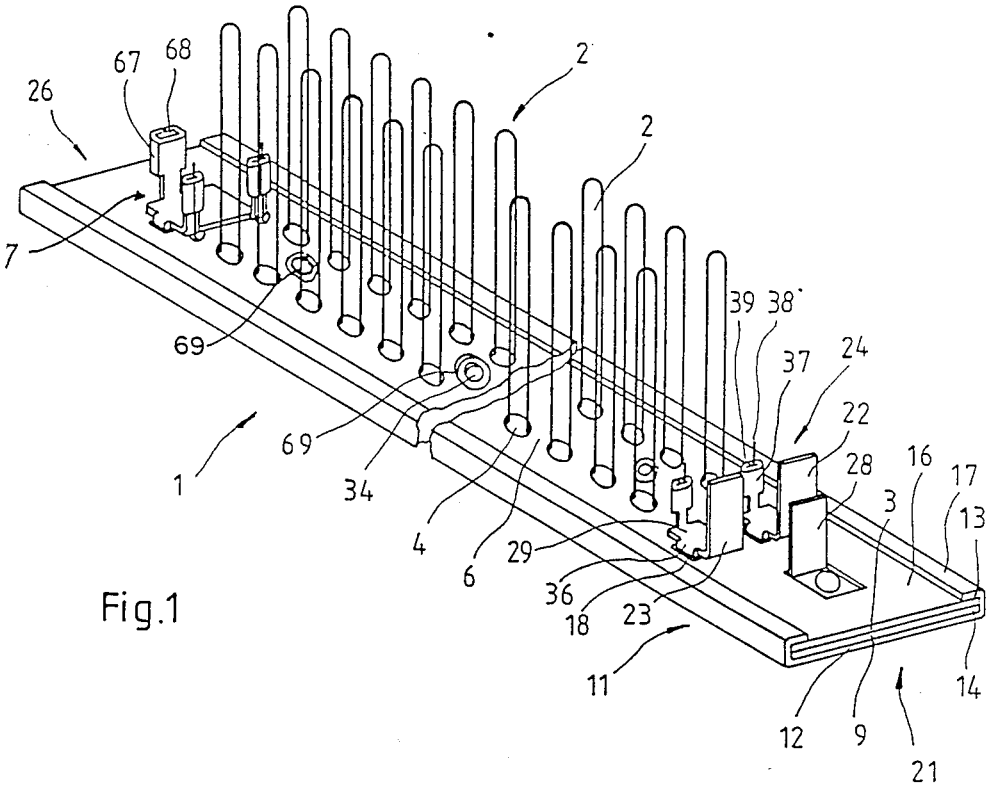
FIG. 1 is a perspective view of an embodiment of constructed in accordance with the present invention.
Figure 2:
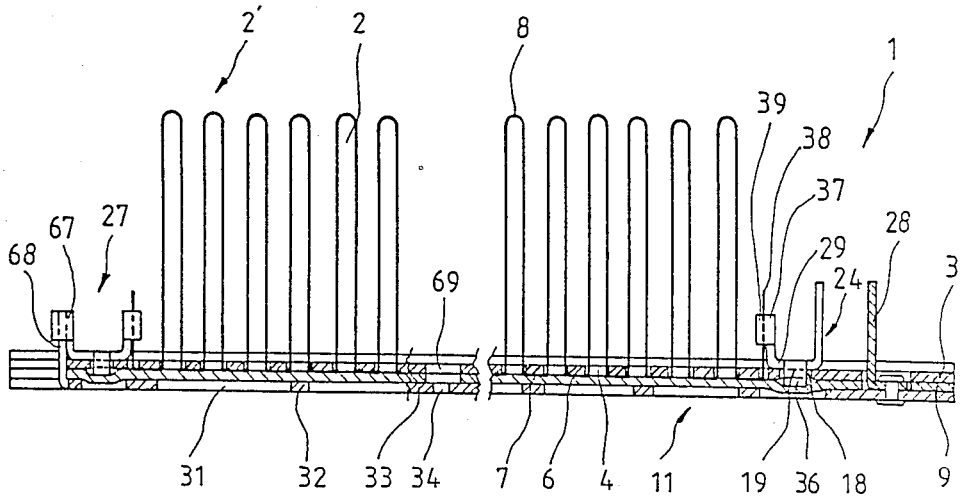
FIG. 2 is a longitudinal cross-sectional view of the heating element of FIG. 1.

Referring now to the drawings wherein like reference numerals are used throughout the various views to designate like parts and, more particularly, to FIG. 1 and 2, according to these figures, in accordance with the present invention, an electrical heating element 1 includes a heat conductor generally designated by the reference numeral 2' with, initially, one or more rows of meander-shaped windings 2 made of an electrical resistance wire. The legs of one winding 2 are longer than a distance between them. The windings 2 are mounted on a first insulating plate 3 in the following manner. More particularly, the insulating plate 3 has openings 4 separated from another by solid parts 6, with one end 7 of the winding passing through an opening 4, and then being guided around a solid part 6, and emerging through an adjacent opening 4. Insulating plate 3 and heat conductor 2' with windings 2 can be assembled in such fashion that insulating plate 3 is guided with its openings over the ends 8 of windings 2 which are away from ends 7. An additional heating plate 9 is placed on the side of insulating plate 3 which faces away from heat conductor 2'.

The heating element described thus far is stiffened and, in particular, the two insulating plates 3, 9 are held together, by a reinforcing rail generally designated by the reference numeral 11 which extends on the side of insulating plates 3, 9 facing away from heat conductor 2 and has a main part 12 extending over the entire width of insulating plates 3, 9, and has tabs 17 on its lengthwise edges, bent around lengthwise edges 13, 14 of insulating plates 3, 9 through approximately 180° up to the top 16 of insulating plate 3. This holds plates 3, 9 firmly together and stabilizes the entire heating element 1.

Initially terminals generally designated by the reference numeral 24 with contact tabs 22, 23 are located at one end generally designated by the reference numeral 21 of heating element 1, with the terminals being electrically connected with heat conductor 2' and serving to connect heat conductor 2' as electrical connectors.

The rows of meanders are brought into contact as follows. In the end area of upper insulating plate 3, an insulating solid part 19 (FIG. 2), delimited by two slots 18, is provided flush with the row of meanders. On this insulating solid part 19 rests a connecting part 24, U-shaped in vertical section, with a bottom solid part 29 which has a tab 36 that fits laterally into slot 18 and fits around insulating solid part 19. In addition, on connecting part 24 on the one side, one of contact tabs 22 or 23 is provided for connection of connecting leads and on the other side a crimping part 37 is provided for connection to the end 38 of one row of windings. The end 38 of the row of windings is brought out for a short distance through a last opening 4 in insulating plate 3 and between legs 39 of crimping part 37, said legs gripping it firmly after they are crushed.

As shown n FIGS. 1 and 2, the rail is likewise provided with a terminal 28 on the first end 21 of heating element 1, with the terminal being riveted to the rail 11, for example. In a vicinity of the end 26 facing away from end 21, the heat conductor 2' is electrically connected with the rail 11, for example, by a rivet or basically in the manner described above for connector 24, with a connecting part 27 which firmly grips a raised tab 68 on tail 11 by a crimping part 67. Thus, the rail 11 serves as a return conductor, so that in the embodiment shown, depending on how the connecting lead connected to contact tabs 22, 23, 28 is wired to a power supply, the two rows of heat conductor 2' can be optionally connected individually or jointly. In addition, if desired, one row of the heat conductor 2' can be used by the central terminal 28 as a lead resistor for a motor, for example, a fan motor.

With one row of windings, by virtue of the provisions described above, a contact made from heat conductor 2 at end 26 which faces away from first end 21, can permit unilateral connection of the power supply to first end 21.

It is especially evident from FIG. 2 that rail 11 has openings 31 in the solid parts 32 on the side facing away from heat conductor 2'. This construction especially improves the compensation of the different thermal expansion behavior of insulating plates 3, 9 and rail 11. In addition, with a suitable arrangement of solid parts 32, with suitable installation conditions, this arrangement can serve possibly to do away with the need for the second insulating plate 9 or to provide the holder of heat conductor 2' roughly half-way up the winding.

Figure 3:
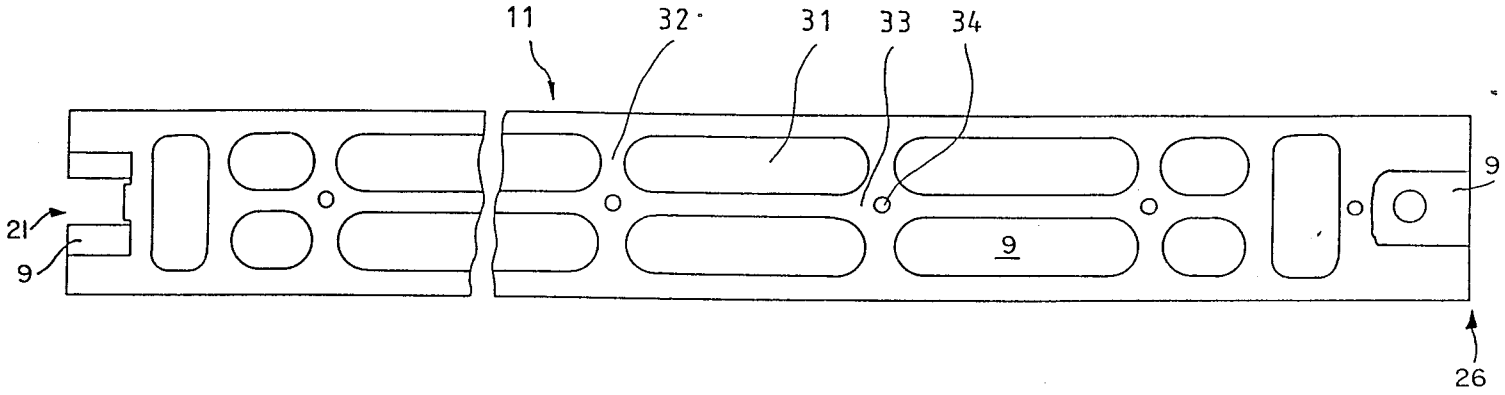
FIG. 3 is a bottom view of the heating element of the present invention.
Figure 4:
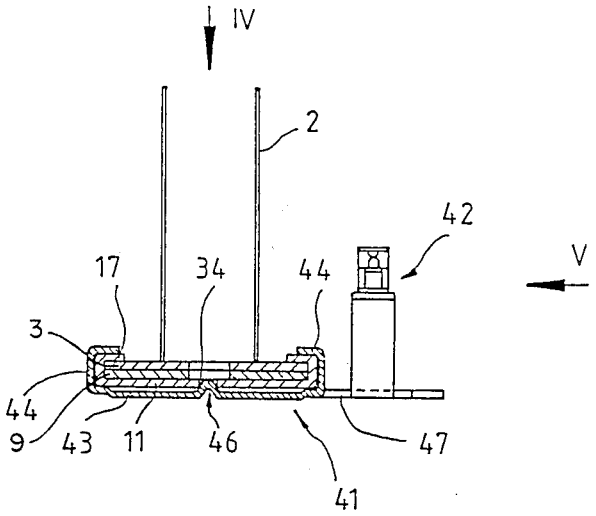
FIG. 4 is a cross-sectional view of the heating element of the present invention equipped with a temperature switch.

As shown in Figs. FIGS. 3 and 4, solid parts 32 of retaining rail 11 have widened areas 33 at the center with through holes 34. These holes 34 can receive a matching projection from a retainer 41 displaceable along rail 11 for a temperature switch 42 (FIG. 4). The holder 41 of a temperature switch 42 can also be connected by eyelets or spot-welded on widened solid parts 32 with openings 34. In this case, insulating plates 3, 9 with holes 34 have flush openings 69 (FIG. 1) with a larger radius, so that it is easy to fasten them to finished heating elements using eyelets.

Figure 5:
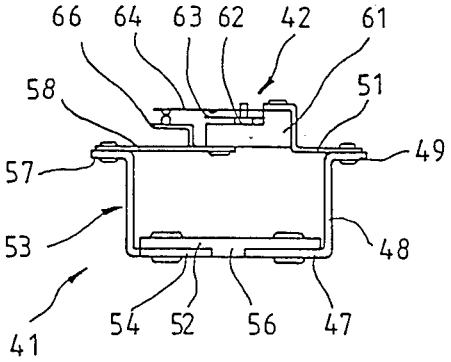
FIG. 5 is a view of a holder for a temperature switch as well as a temperature switch as view in a direction of the arrow V in FIG. 4.
Figure 6:
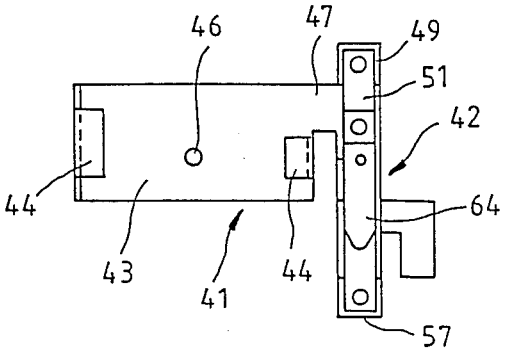
FIG. 6, is a top view of the temperature switch with retainer as viewed in the direction of the arrow VI in FIG. 4.

A suitable holder 41 for a temperature switch 42 is shown, for example, in FIGS. 4 to 6 in. The holder 41 initially has a solid part 43 which is hairpin-shaped and spans the width of rail 11, at whose ends tabs 44 are formed which fit around tabs 17 of retaining rail 11, by means of which tabs 44 retainer 41 is held on rail 11 and is displaceable along the latter. A bead 46 is provided centrally in solid part 43, serving as a counter-bearing to tabs 44 on the underside of retaining rail 11, or in the vicinity of openings 32 in lower insulating plate 14. By bead 46, retainer 41, after location at the desired position on retaining rail 11, can be fixed in position, for example, by spot-welding or the like.

A projection 47 extends on one side from solid part 43, essentially flush with the latter, from which projection in turn a flange 48 projects upward, whose end 49 is bent laterally. Temperature switch 42 with a contact 51 is mounted on this bent end 49, or fastened by eyelets. An angular part 53 with a flange 54 is mounted on solid part 47 by an insulating bridge 52 and insulated from solid part 47. Between projection 47 and flange 54 a projection 56 of insulator 52 projects by means of which parts 47, 54 connected with insulator 52, for example by eyelets, are prevented from rotating.

On a flange 57, which is bent down from angular part 53 contrary to the direction of projection 54 as well as projection 49 of part 48, the other end 58 of temperature switch 42 is fastened which is securely held as a result. Reference number 61 refers to an insulating support for the temperature switch while 62 is a mount for a bimetallic disk 63, 64 is the movable contact switched by bimetallic disk 63, and 66 represents the fixed matching contact of temperature switch 42, which is cut out of contact strip 58 and bent outward.

In particular, the construction according to the invention also permits several temperature switches to be arranged in sequence on retaining rail 11 and possibly mounted so that local overheating, which in a unit with only one monitor, when it occurs at a distance from the latter, would not cause a safety shutoff, is reliably provided for. In addition, several temperature switches can be provided in the form of regulators. In addition, some of the temperature switches can be regulators and others can be monitors.

I claim:

1. An electrical heating element comprising at least one insulating plate provided with a plurality of openings and a heat conductor including meander-shaped windings, with the individual meandershaped windings being retained in the openings of the at least one insulating plate and being separated by solid parts, wherein a one-piece retaining rail extends over an entire width of the at least one insulating plate and essentially over a length thereof, the retaining rail includes tabs extending along side edges of the at least one insulating plate on both sides, said tabs being adapted to be bent over to grip the at least one insulating plate, and wherein the individual windings extends substantially perpendicular to the at least one insulating plate.

2. An electrical heating element according to claim 1, further comprising terminal means for enabling a connection of electrical connectors provided at one end of the retaining rail, and heat conductors are electrically connected at an opposite end with the retaining rail.

3. An electrical heating element according to one of claims 1 or 2 wherein the retaining rail has openings and solid parts on a side which is away from the tabs.

4. An electrical heating element according to claim 3, wherein the windings of the heat conductors passing through the openings in the at least one insulating plate are guided around the solid parts of the at least one insulating plate and are retained by the latter.

5. An electrical heating element according to claim 4, wherein a temperature switch is displaceably mounted on the retaining rail.

6. An electrical heating element according to claim 5, wherein the retaining rail is surrounded by tabs of a holder for the temperature switch.

7. An electrical heating element according to claim 6, wherein the temperature switch is mountable on the retaining rail by solid parts of the latter.

8. An electrical heating element according to claim 7, wherein eyelets are provided for locking the temperature switch in position.

9. An electrical heating element according to claim 6, wherein a bridge-shaped solid part connecting the tabs of the temperature switch holder which fit around the retaining rail, is provided with a central elevation.

10. An electrical heating element according to claim 9, wherein the temperature switch is supported by two supporting parts held apart by an insulating part.

11. An electrical heating element according to claim 10, wherein the two supporting parts are non-rotatably connected to one another.

12. An electrical heating element according to claim 11, wherein the two supporting parts are connected to the insulating part by eyelets, and a projection of the insulating part corresponding to a distance between the two projections, projects between corresponding mounting projections of the two supporting parts.

13. An electrical heating element according to claim 12, wherein one of the supporting parts is firmly attached to the bridge-shaped solid part guided on the retaining rail and is preferably made integral therewith.

* * * * *